US009275648B2

(12) United States Patent
Lee et al.

(10) Patent No.: US 9,275,648 B2
(45) Date of Patent: Mar. 1, 2016

(54) METHOD AND APPARATUS FOR PROCESSING AUDIO SIGNAL USING SPECTRAL DATA OF AUDIO SIGNAL

(75) Inventors: Hyun Kook Lee, Seocho-gu Seoul (KR); Dong Soo Kim, Seocho-gu Seoul (KR); Sung Yong Yoon, Seocho-gu Seoul (KR); Hee Suk Pang, Seocho-gu Seoul (KR); Jae Hyun Lim, Seocho-gu Seoul (KR)

(73) Assignee: LG ELECTRONICS INC., Seoul (KR)

( * ) Notice: Subject to any disclaimer, the term of this patent is extended or adjusted under 35 U.S.C. 154(b) by 778 days.

(21) Appl. No.: 12/747,148

(22) PCT Filed: Dec. 18, 2008

(86) PCT No.: PCT/KR2008/007522

§ 371 (c)(1),
(2), (4) Date: Jun. 9, 2010

(87) PCT Pub. No.: WO2009/078681

PCT Pub. Date: Jun. 25, 2009

(65) Prior Publication Data

US 2010/0292994 A1 Nov. 18, 2010

Related U.S. Application Data

(60) Provisional application No. 61/014,441, filed on Dec. 18, 2007, provisional application No. 61/118,647, filed on Nov. 30, 2008.

(51) Int. Cl.
*G10L 19/00* (2013.01)
*G10L 19/12* (2013.01)
(Continued)

(52) U.S. Cl.
CPC ..... *G10L 19/0204* (2013.01); *G10L 19/008* (2013.01); *G10L 21/038* (2013.01); *G10L 19/24* (2013.01)

(58) Field of Classification Search
CPC ..... G10L 19/00; G10L 19/0019; G10L 19/02; G10L 19/0204; G10L 19/0208; G10L 19/04; G10L 19/06; G10L 19/08; G10L 19/16; G10L 19/18; G10L 19/24; G10L 19/265; G10L 21/038; G10L 21/0388
USPC ..... 704/220, 221, 500–504
See application file for complete search history.

(56) References Cited

U.S. PATENT DOCUMENTS 5,857,168 A * 1/1999 Ozawa ..... G10L 19/10 704/219
5,956,674 A 9/1999 Smyth et al.
(Continued)

FOREIGN PATENT DOCUMENTS

CN 1430777 A 7/2003
CN 1527995 A 9/2004
(Continued)

OTHER PUBLICATIONS

Portnoff, M.; , "Implementation of the digital phase vocoder using the fast Fourier transform," Acoustics, Speech and Signal Processing, IEEE Transactions on , vol. 24, No. 3, pp. 243-248, Jun. 1976.*
(Continued)

*Primary Examiner* — Paras D Shah
(74) *Attorney, Agent, or Firm* — Birch, Stewart, Kolasch & Birch, LLP

(57) ABSTRACT

A method of processing an audio signal is disclosed. The present invention includes receiving spectral data corresponding to a first band in a frequency band including the first band and a second band, determining a copy band based on frequency information of the copy band corresponding to a partial band of the first band, and generating spectral data of a target band corresponding to the second band using the spectral data of the copy band, wherein the copy band exists in an upper part of the first band.

9 Claims, 8 Drawing Sheets

(51) Int. Cl.

| | |
|---|---|
| ***G10L 19/02*** | (2013.01) |
| ***G10L 19/008*** | (2013.01) |
| ***G10L 21/038*** | (2013.01) |
| *G10L 19/24* | (2013.01) |

(56) References Cited

U.S. PATENT DOCUMENTS

| | | | | |
|---|---|---|---|---|
| 6,680,972 | B1 * | 1/2004 | Liljeryd et al. | 375/240 |
| 7,139,702 | B2 * | 11/2006 | Tsushima et al. | 704/222 |
| 7,205,910 | B2 * | 4/2007 | Honma et al. | 341/50 |
| 7,359,854 | B2 * | 4/2008 | Nilsson et al. | 704/219 |
| 7,630,882 | B2 * | 12/2009 | Mehrotra et al. | 704/205 |
| 7,831,434 | B2 * | 11/2010 | Mehrotra et al. | 704/500 |
| 7,864,843 | B2 * | 1/2011 | Choo et al. | 375/240.12 |
| 7,885,819 | B2 * | 2/2011 | Koishida et al. | 704/500 |
| 7,953,605 | B2 * | 5/2011 | Sinha et al. | 704/501 |
| 8,036,903 | B2 * | 10/2011 | Grill et al. | 704/500 |
| 8,265,940 | B2 * | 9/2012 | Geiser et al. | 704/500 |
| 2003/0093271 | A1 | 5/2003 | Tsushima et al. | |
| 2004/0028125 | A1 | 2/2004 | Sato | |
| 2004/0131203 | A1 | 7/2004 | Liljeryd et al. | |
| 2005/0004793 | A1 * | 1/2005 | Ojala et al. | 704/219 |
| 2005/0246164 | A1 * | 11/2005 | Ojala et al. | 704/205 |
| 2006/0147048 | A1 * | 7/2006 | Breebaart | G10L 19/008 381/23 |
| 2007/0038439 | A1 * | 2/2007 | Schuijers et al. | 704/212 |
| 2007/0271095 | A1 | 11/2007 | Miyasaka et al. | |
| 2007/0282599 | A1 * | 12/2007 | Choo et al. | 704/205 |
| 2008/0077412 | A1 * | 3/2008 | Oh et al. | 704/500 |
| 2008/0109215 | A1 * | 5/2008 | Liu et al. | 704/200.1 |
| 2008/0129350 | A1 * | 6/2008 | Mitsufuji | G10L 21/038 327/113 |
| 2008/0300866 | A1 * | 12/2008 | Mukhtar et al. | 704/205 |
| 2009/0006103 | A1 * | 1/2009 | Koishida et al. | 704/500 |
| 2009/0125300 | A1 * | 5/2009 | Oshikiri | G10L 19/24 704/207 |
| 2009/0271204 | A1 * | 10/2009 | Tammi | 704/500 |

FOREIGN PATENT DOCUMENTS

| | | | |
|---|---|---|---|
| EP | 1 768 451 | A1 | 3/2007 |
| JP | 8-263098 | A | 10/1996 |
| JP | 11-175098 | A | 7/1999 |
| JP | 2000-75899 | A | 3/2000 |
| JP | 2001-521648 | A | 11/2001 |
| JP | 2002-041089 | A | 2/2002 |
| JP | 2003-216190 | A | 7/2003 |
| JP | 2004-053940 | A | 2/2004 |
| JP | 2004-78183 | A | 3/2004 |
| JP | 2004-198485 | A | 7/2004 |
| JP | 2007-110565 | A | 4/2007 |
| KR | 10-2005-0122267 | A | 12/2005 |
| KR | 10-0566630 | | 3/2006 |
| KR | 10-2006-0131745 | A | 12/2006 |
| RU | 2131169 | C1 | 5/1999 |
| RU | 2214048 | C2 | 10/2003 |
| WO | 98/20709 | A1 | 5/1998 |
| WO | 01/91111 | A1 | 11/2001 |

OTHER PUBLICATIONS

Wolters et al., "A Closer Look into MPEG-4 High Efficiency AAC," Audio Engineering Society Convention Paper, 115th Convention, New York, NY, USA, Oct. 10-13, 2003, XP008063876.

Korean Office Action dated Feb. 8, 2011 corresponding to Korean Application No. 10-2009-0090705.

* cited by examiner

METHOD AND APPARATUS FOR PROCESSING AUDIO SIGNAL USING SPECTRAL DATA OF AUDIO SIGNAL

This application is the National Phase of PCT International Application No. PCT/KR2008/007522, filed on Dec. 18, 2008, which claims priority under 35 U.S.C. 119(e) to U.S. Provisional Application No. 61/014,441, filed on Dec. 18, 2007 and U.S. Provisional Application No. 61/118,647, filed on Nov. 30, 2008.

TECHNICAL FIELD

The present invention relates to an apparatus for processing a signal and method thereof. Although the present invention is suitable for a wide scope of applications, it is particularly suitable for encoding and decoding audio signals using spectral data of signal.

BACKGROUND ART

Generally, in processing an audio signal using signal characteristics, the audio signal is processed based on characteristics between signals from different bands.

DISCLOSURE OF THE INVENTION

Technical Problem

Conventional art is insufficient to process an audio signal effectively based on characteristics between signals from different bands.

Technical Solution

The present invention is directed to an apparatus for processing a signal and method thereof that substantially obviate one or more of the problems due to limitations and disadvantages of the related art.

An object of the present invention is to provide an apparatus for processing a signal and method thereof, by which an audio signal can be processed based on characteristics between signals from different bands.

Another object of the present invention is to provide an apparatus for processing a signal and method thereof, by which spectral data on a different band can be obtained in a manner of selecting appropriate spectral data from a plurality of spectral data of a specific band.

A further object of the present invention is to provide an apparatus for processing a signal and method thereof, by which a bitrate can be minimized despite processing such a signal having a different characteristic as a speech signal, an audio signal and the like by a scheme appropriate for the corresponding characteristic.

ADVANTAGEOUS EFFECTS

The present invention provides the following effects or advantages.

First, the present invention decodes a signal having a speech signal characteristic as a speech signal and decodes a signal having an audio signal characteristic as an audio signal. Therefore, the present invention can adaptively select a decoding scheme that matches each signal characteristic.

Secondly, the present invention obtains spectral data of a different band by selecting the most appropriate spectral data from transferred spectral data, thereby increasing a reconstruction rate of an audio signal.

Thirdly, the present invention selects spectral data using start band information transferred from an encoder. Therefore, the present invention increases accuracy in selecting spectral data but decreases complexity required for carrying out an operation.

Fourthly, the present invention omits a transfer of spectral data corresponding to a partial band, thereby reducing bits required for a spectral data transfer considerably.

DESCRIPTION OF DRAWINGS

The accompanying drawings, which are included to provide further understanding of the invention and are incorporated in and constitute a part of this specification, illustrate embodiments of the invention and together with the description serve to explain the principles of the invention.

In the drawings.

BEST MODE

Figure 1:
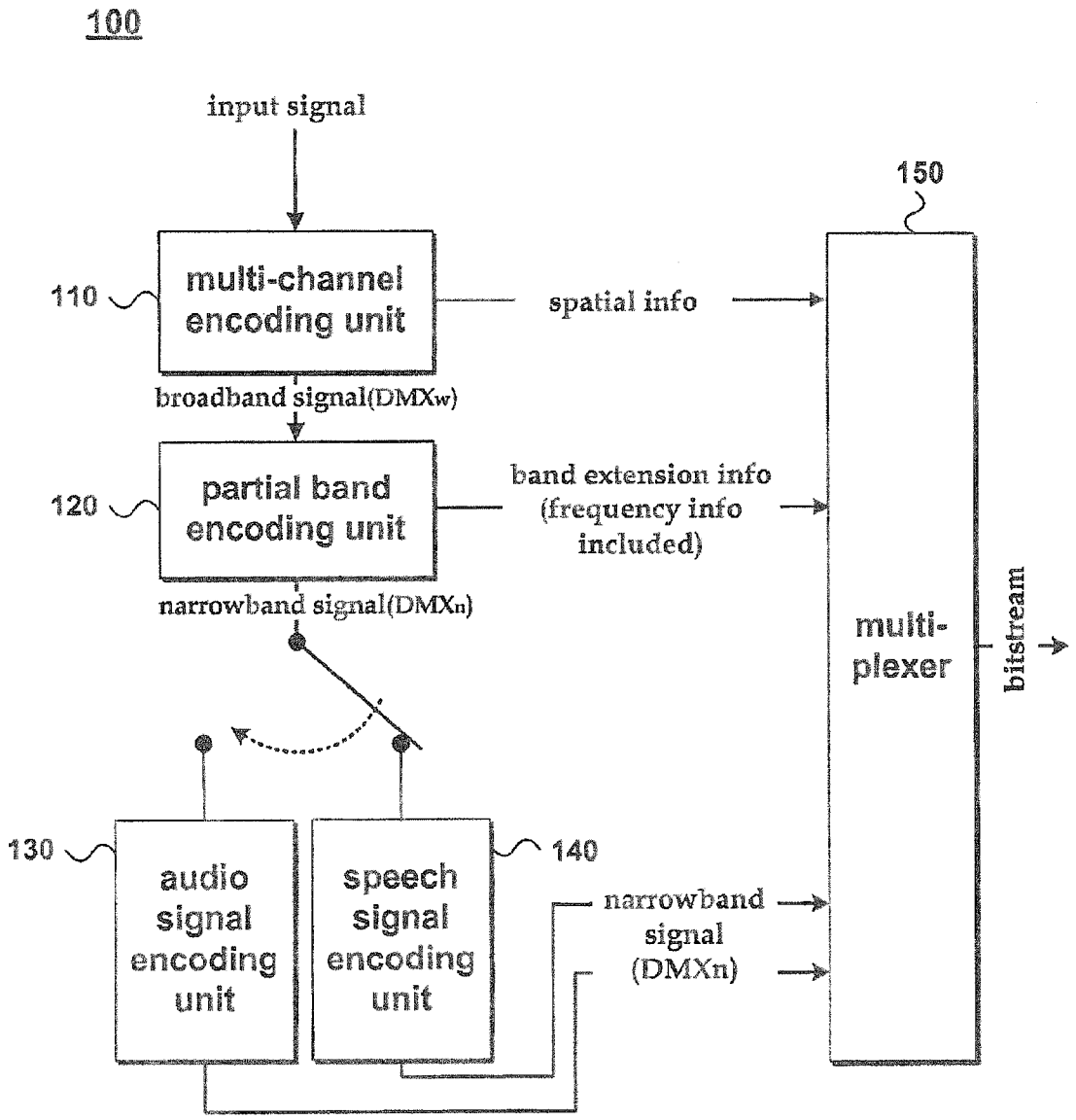
FIG. 1 is a block diagram of an audio signal encoding apparatus according to an embodiment of the present invention.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a signal processing apparatus according to the present invention includes a copy band determining unit, a band extension information receiving unit and a target band generating unit. And, the target band generating unit includes a time dilatation/compression unit and a decimation unit. Moreover, the target band generating unit can further include a filtering unit.

The copy band determining unit receives spectral data corresponding to a low frequency band in a frequency band including the low frequency band and a high frequency band. The copy band determining unit then determines a copy band based on frequency information of the copy band corresponding to a partial band of the low frequency band.

The band extension information obtaining unit obtains side information for generating a target band from the copy band.

In this case, the side information can be obtained from a bitstream and can include gain information, harmonic information and the like.

The target information generating unit generates spectral data of a target band corresponding to the high frequency band using the spectral data of the copy band. In this case, the copy band can exist above the low frequency band. It is able to generate the high frequency band using the copy band existing on the low frequency band. In the same way, it is also possible to generate the low frequency band using the copy band existing on the high frequency band.

The target band generating unit includes the time dilatation/compression unit and the decimation unit and is able to further include the filtering unit. In particular, the copy band can be obtained from the bitstream or can be obtained by filtering the received spectral data.

In this case, frequency information of the copy band indicates at least one of a start frequency, a start band and index information indicating the start band. And, the spectral data of the target band can be generated using at least one of gain information corresponding to a gain between the spectral data of the copy band and the spectral data of the target band, and harmonic information of the copy band. The spectral data of the low frequency band can be decoded by one of the audio signal and the speech signal.

The present invention is applicable to core coding of AAC, AC3, AMR and the like or future core coding. The following descriptions mainly refer applications on downmix signal but are not limited.

It is understood that both the foregoing general description and the following detailed description are exemplary and explanatory and are intended to provide further explanation of the invention as claimed.

Mode For Invention

Reference is made to the preferred embodiments of the present invention in detail, examples of which are illustrated in the accompanying drawings.

Terminologies in the present invention can be construed as the following references. Terminologies not disclosed in this specification can be construed as concepts matching the idea of the present invention. It is understood that 'coding' can be construed both as encoding or decoding in a specific case. 'Information' in this disclosure can generally mean values, parameters, coefficients, elements and the like and its meaning can be construed as different occasionally, by which the present invention is not limited.

Figure 2:
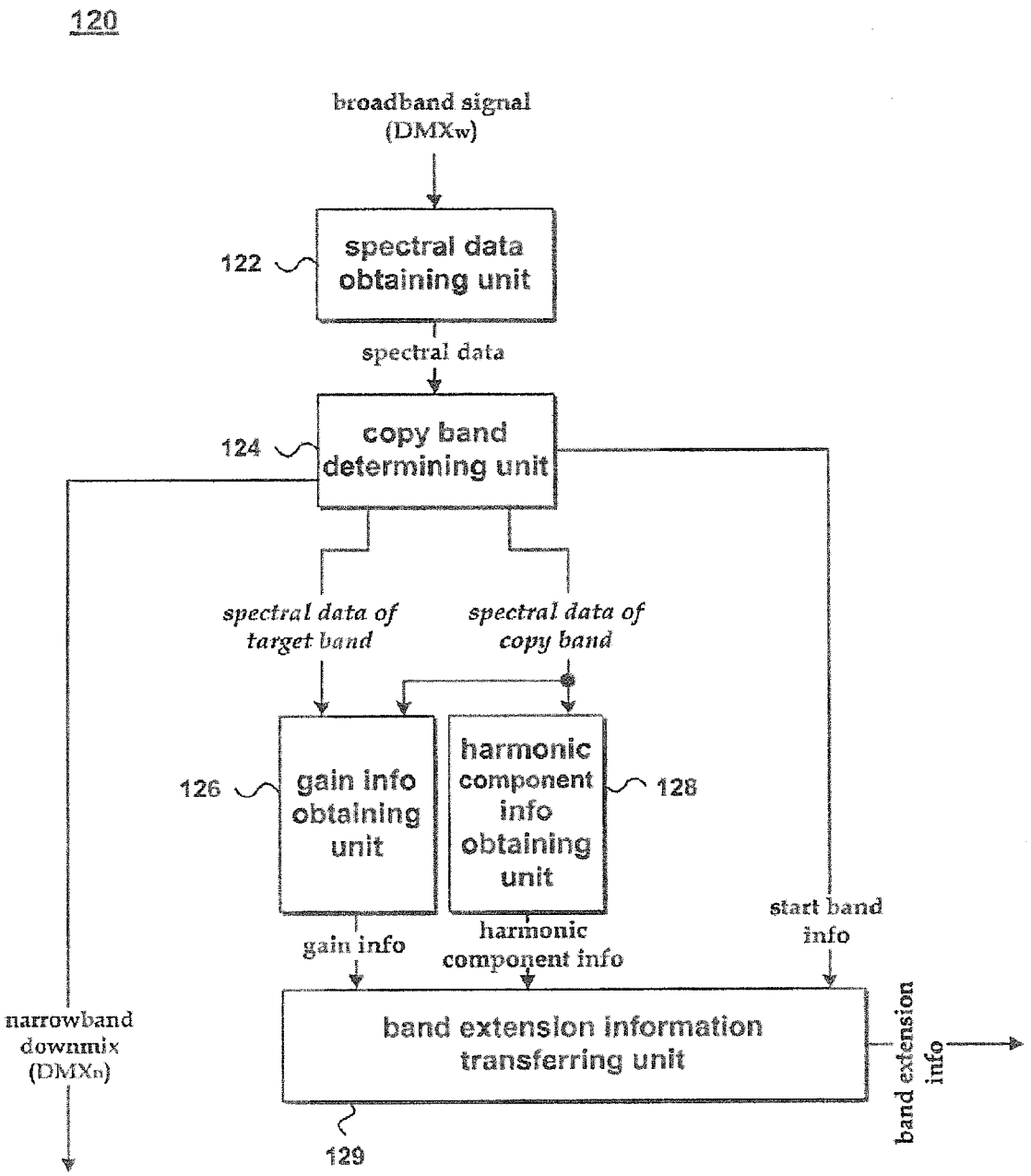
FIG. 2 is a detailed block diagram of a partial band encoding unit shown in FIG. 1.

FIG. 1 is a block diagram of an audio signal encoding apparatus according to an embodiment of the present invention, and FIG. 2 is a detailed block diagram of a partial band encoding unit shown in FIG. 1.

Referring to FIG. 1, an audio signal encoding apparatus according to an embodiment of the present invention includes a multi-channel encoding unit 110, a partial band encoding unit 120, an audio signal encoding unit 130, a speech signal encoding unit 140 and a multiplexer 150.

The multi-channel encoding unit 110 receives a plurality of channel signals (hereinafter named a multi-channel signal) and then generates a downmix signal by downmixing the multi-channel signal. The multi-channel encoding unit 110 generates spatial information required for upmixing the downmix signal to the multi-channel signal. In this case, the spatial information can include channel level difference information, inter-channel correlation information, channel prediction coefficient and downmix gain information and the like.

Meanwhile, this downmix signal can include a signal in a time-domain (e.g., residual data) or information of a frequency-transformed frequency domain (e.g., scale factor coefficient, spectral data).

The partial band encoding unit 120 generates a narrowband signal and band extension information from a broadband signal.

In this case, an original signal including a plurality of bands is named a broadband signal and at least one of a plurality of the bands is named a narrowband signal. For instance, in a broadband signal including two bands (a low frequency band and a high frequency band), either one of the bands is named a narrowband signal. Moreover, a partial band indicates a portion of the whole narrowband signal and shall be named a copy band in the following description.

The band extension information is the information for generating a target band using the copy band. And, the band extension information can include frequency information, gain information, harmonic information and the like. In a decoder, the broadband signal is generated from combining the target band with the narrowband signal.

If a specific frame or segment of a downmix signal (narrowband downmix signal $DMX_n$) has a large audio characteristic, the audio signal encoding unit 130 encodes the downmix signal according to an audio coding scheme. In this case, the audio signal may comply with AAC (advanced audio coding) standard or HE-AAC (high efficiency advanced audio coding) standard, by which the present invention is not limited. Moreover, the audio signal encoding unit 130 may correspond to an MDCT (modified discrete transform) encoder.

If a specific frame or segment of a dowrunix signal (narrowband downmix signal $DMX_n$) has a large speech characteristic, the speech signal encoding unit 140 encodes the downmix signal according to a speech coding scheme. In this case, the speech signal can include G. 7XX or AMR-series, by which examples of the speech signal are not limited. Meanwhile, the speech signal encoding unit 140 can further use a linear prediction coding (LPC) scheme. If a harmonic signal has high redundancy on a time axis, it can be modeled by linear prediction for predicting a present signal from a past signal. In this case, if the linear prediction coding scheme is adopted, it is able to increase coding efficiency. Moreover, the speech signal encoding unit 140 can correspond to a time domain encoder.

Thus, the narrowband downmix is encoded per frame or segment by either the audio signal encoding unit 130 or the speech signal encoding unit 140.

And, the multiplexer 150 generates a bitstream by multiplexing the spatial information generated by the multi-channel encoding unit 110, the band extension information generated by the partial band encoding unit 120 and the encoded narrowband downmix signal.

In the following description, the detailed configuration of the partial band encoding unit 120 is explained with reference to FIG. 2.

Referring to FIG. 2, the partial band encoding unit 120 includes a spectral data obtaining unit 122, a copy band determining unit 124, a gain information obtaining unit 126, a harmonic component information obtaining unit 128, and a band extension information transferring unit 129.

If a received broadband signal is not spectral data, the spectral data obtaining unit 122 generates spectral data in a manner of converting a downmix to a spectral coefficient, scaling the spectral coefficient with a scale factor and then performing quantization. In this case, the spectral data includes spectral data of broadband corresponding to a broadband downmix.

The copy band determining unit 124 determines a copy band and a target band based on the spectral data of the broadband and generates frequency information for band extension. In this case, the frequency information can include a start frequency, start band information or the like. In the following description, the copy band and the like are explained with reference to FIG. 3 and FIG. 4.

Figure 3:
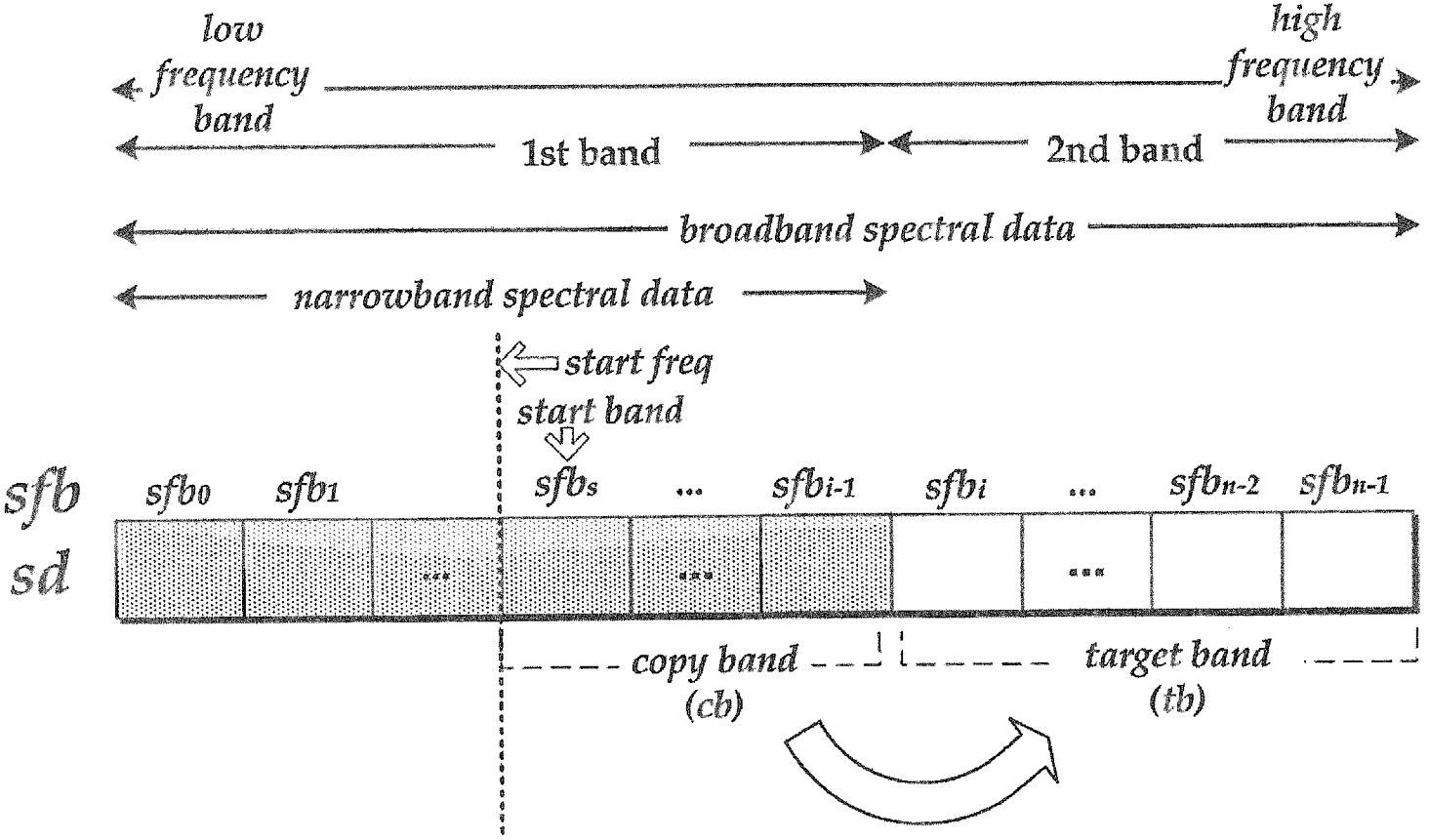
FIG. 3 is a diagram for relations among a copy band, a target band and a start band according to the present invention.
Figure 4:
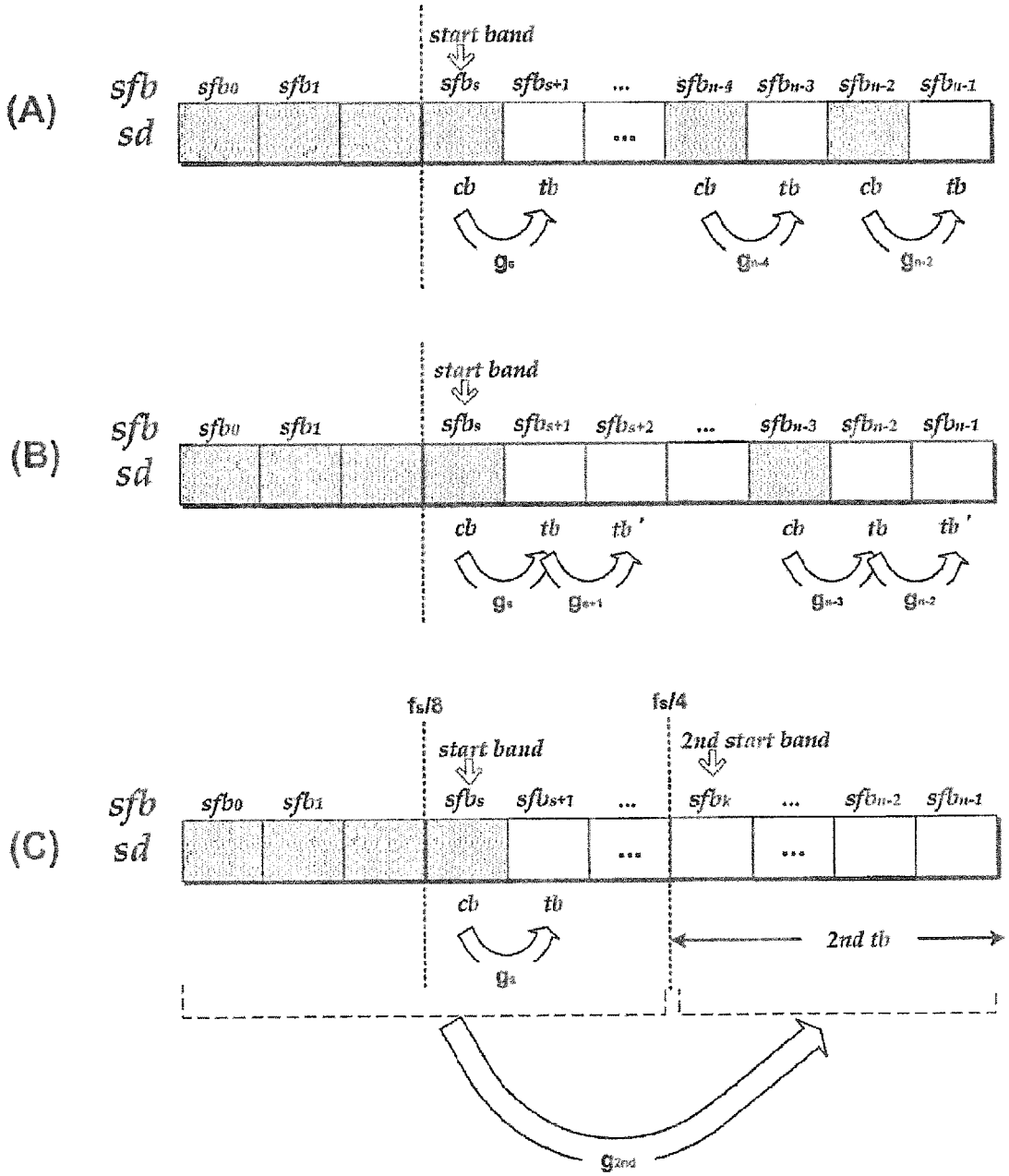
FIG. 4 is a diagram for partial band extension according to various embodiments of the present invention.

FIG. 3 is a diagram for relations among a copy band, a target band and a start band according to the present invention, and FIG. 4 is a diagram for partial band extension according to second to fourth embodiments of the present invention.

Referring to FIG. 3, total n scale factor bands (sfb) 0 to n−1 exist and spectral data corresponding to the scale factor bands $sfb_0$ to $sfb_{n-1}$ exist, respectively. Spectral data $sd_i$ belonging to a specific band can mean a set of a plurality of spectral data $sd_{i_0}$ to $sd_{i_m-1}$. The number $m_i$ of the spectral data can be generated to correspond to a spectral data unit, a band unit or a unit over the former unit. In this example, a $0^{th}$ scale factor band $sfb_0$ corresponds to a low frequency band and an $(n-1)^{th}$ scale factor band $sfb_{n-1}$ corresponds to an upper part, i.e., a high frequency band. Alternatively, a configuration reverse to this example is possible.

Spectral data corresponding to a broadband signal is the spectral data corresponding to the total band $sfb_0$ to $sfb_{n-1}$ including a first band and a second band. Spectral data corresponding to a narrowband downmix $DMX_n$ is the spectral data corresponding to the first band and include the spectral data of the $0^{th}$ band $sfb_0$ to the spectral data of the $(i-1)^{th}$ band $sfb_{i-1}$. In particular, the narrowband spectral data are transferred to a decoder, while the spectral data of the rest of the bands $sfb_1$ to $sfb_{n-1}$ are not transferred thereto.

Thus, the decoder generates the band that does not carry the spectral data. And, this band is called a target band tb. Meanwhile, a copy band cb is a scale factor band of spectral data used in generating the spectral data of the target band tb. The copy band includes portions $sfb_s$ to $sfb_{i-1}$ of the bands $sfb_0$ to $sfb_{i-1}$ corresponding to the narrowband downmix. A band, from which the copy band cb starts, is a start band sb and a frequency of the start band is a start frequency. In other words, the copy band cb can be the start band sb itself, may include the start band and a frequency band higher than the start band, or can include the start band and a frequency band lower than the start band.

According to the present invention, an encoder generates narrowband spectral data and band extension information using broadband spectral data, while a decoder generates spectral data of a target band using spectral data of a copy band among narrowband spectral data.

FIG. 4 shows three kinds of embodiments of partial band extension. A copy band can generate a target band as a partial band of a whole narrow band. In this case, the copy band can be located on an upper frequency band. At least one copy band can exist and in case a plurality of copy bands exist, the bands can be equally or variably spaced apart from each other.

Referring to (A) of FIG. 4, partial band extension is shown in case a bandwidth of a copy band is equal to a bandwidth of a target band. In particular, the copy band cb includes an $s^{th}$ band $sfb_s$ corresponding to a start band sb, an $(n-4)^{th}$ band $sfb_{n-4}$ and an $(n-2)^{th}$ band $sfb_{n-2}$. An encoder is able to omit transferring of spectral data of the target band located on the right of the copy band using the spectral data of the copy band. Meanwhile, it is able to generate gain information (g) which is a difference between the spectral data of the copy band and the spectral data of the target band. This will be explained later.

(B) of FIG. 4 indicates a copy band and a target band that are different in bandwidth. A bandwidth of the target band is equal to or greater than two bandwidths (tb and tb') of the copy band. In this case, bandwidths of the target band can be generated by applying different gains $g_s$ and $g_{s+1}$, respectively, to the spectral data of the copy band bandwidth and tb of the target band.

Referring to (C) of FIG. 4, after spectral data of a target band have been generated using spectral data of a copy band, it is able to generate spectral data of second target band, $sfb_k$ to $sfb_{n-1}$, using spectral data corresponding to bands $sfb_{k0}$ to $sfb_{k-1}$ adjacent to a second start bad $sfb_k$. In this case, a frequency band of a start band corresponds to ⅛ of a sampling frequency $f_s$ and the secondary start band may correspond to ¼ of the sampling frequency $f_s$, by which examples of the present invention are not limited.

The relevance of the target band, the copy band and the start band according to the various embodiments of the present invention are previously explained. The rest of the elements are explained with reference to FIG. 2 as follows.

As mentioned in the foregoing description, the copy band determining unit 124 determines a copy band, a target band and a start band, sb of the copy band. The start band can be variably determined per frame. This can also be determined according to a characteristic of a signal per frame. In particular, the start band can be determined according to whether a signal is transient or stationary. For example, a start band can be determined as a low frequency when a signal is transient since the signal has less harmonic components than when it is stationary.

Meanwhile, the start band can be determined as a numerical value of brightness of sound using a spectral centroid. For instance, if a sound is relatively high (when high-pitched tone is dominant), a start band can be formed in high frequency band. If a sound is relatively low (when low-pitched tone is dominant), a start band can be formed in low frequency band. Although the start band is determined variably per frame, it is preferable to form the start band by considering the trade-off between sound quality and bitrate.

The copy band determining unit 124 outputs a narrowband downmix $DMX_n$ or the spectral data of the narrowband excluding the spectral data of the target band. This narrowband downmix is inputted to the audio signal encoding unit or the speech signal encoding unit described in FIG. 1.

The copy band determining unit 124 generates start band information that indicates start frequency information on a start frequency from which the copy band cb starts or a start band information of the copy band cb. The start band information can be represented not only as a substantial value but also as index information. When the start band information is represented as the index information, the start band information corresponding to the index is stored in a table and can be used in a decoder. The start band information is forwarded to the band extension information transferring unit 129 and is then included as band extension information.

The gain information obtaining unit 126 generates gain information using the spectral data of the target band and the copy band. In this case, the gain information can be defined as an energy ratio of target band to copy band and can be defined as the following formula.

$$g_i = \frac{\text{energy(target_band)}}{\text{energy(copy_band)}} \quad \text{[Formula 1]}$$

In Formula 1, '$g_i$' indicates a gain and 'i' indicates a current target band.

This gain information can be determined for each target band as previously shown. The gain information is forwarded to the band extension information transferring unit 129 and is then included as the band extension information as well.

The harmonic component information obtaining unit 128 generates harmonic component information by analyzing a harmonic component of the copy band. The harmonic component information is forwarded to the band extension information transferring unit 129 and is then included as the band extension information as well.

The band extension information transferring unit 129 outputs band extension information having the start band information, gain information and harmonic component information included therein. This band extension information is inputted to the multiplexer described with reference to FIG. 1.

Thus, the narrowband downmix and the band extension information are generated by the above-described method. In the following description, a process for generating a broadband downmix in a decoder using band extension information and a narrowband downmix is explained.

Figure 5:
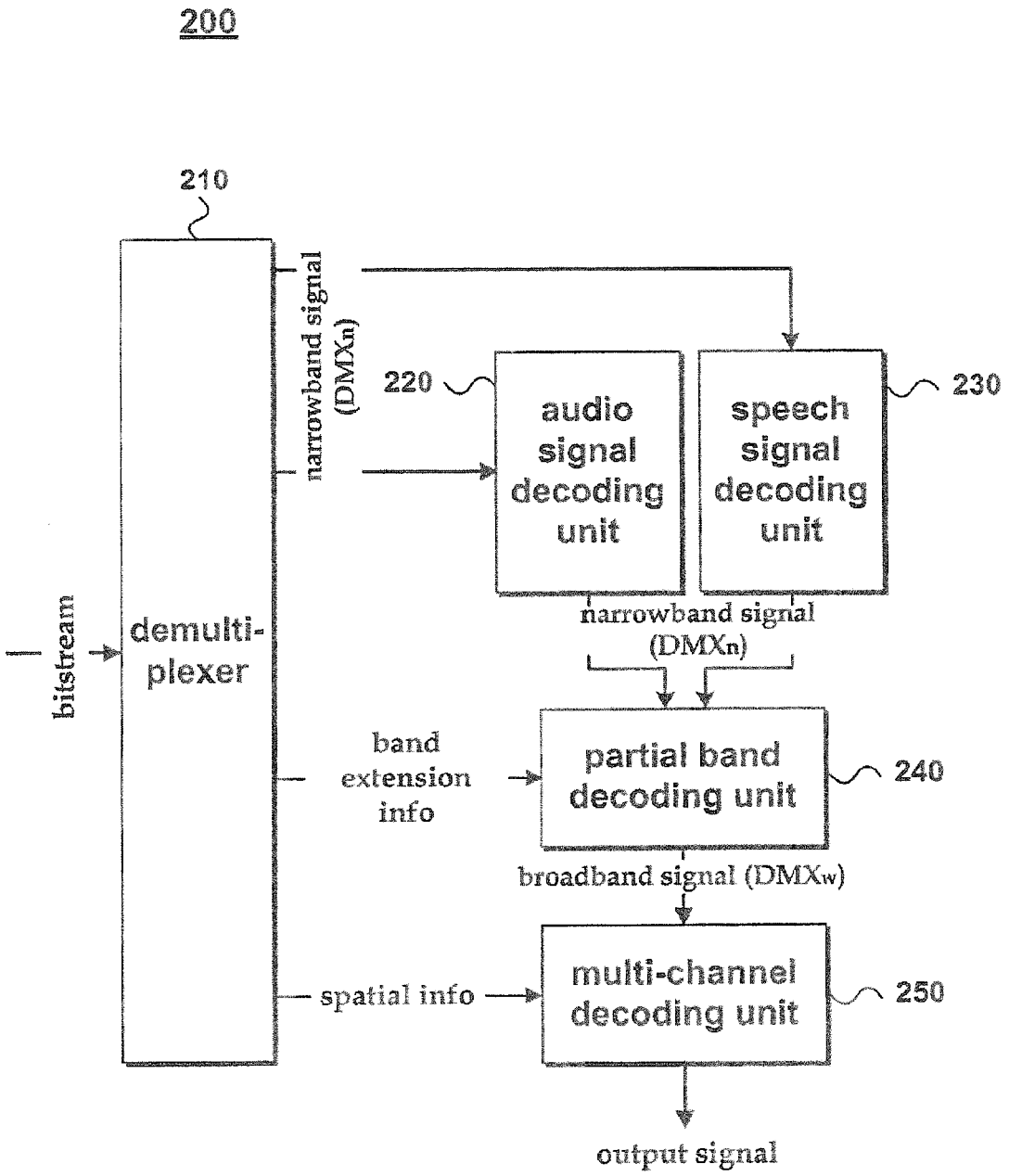
FIG. 5 is a block diagram of an audio signal decoding apparatus according to an embodiment of the present invention.
Figure 6:
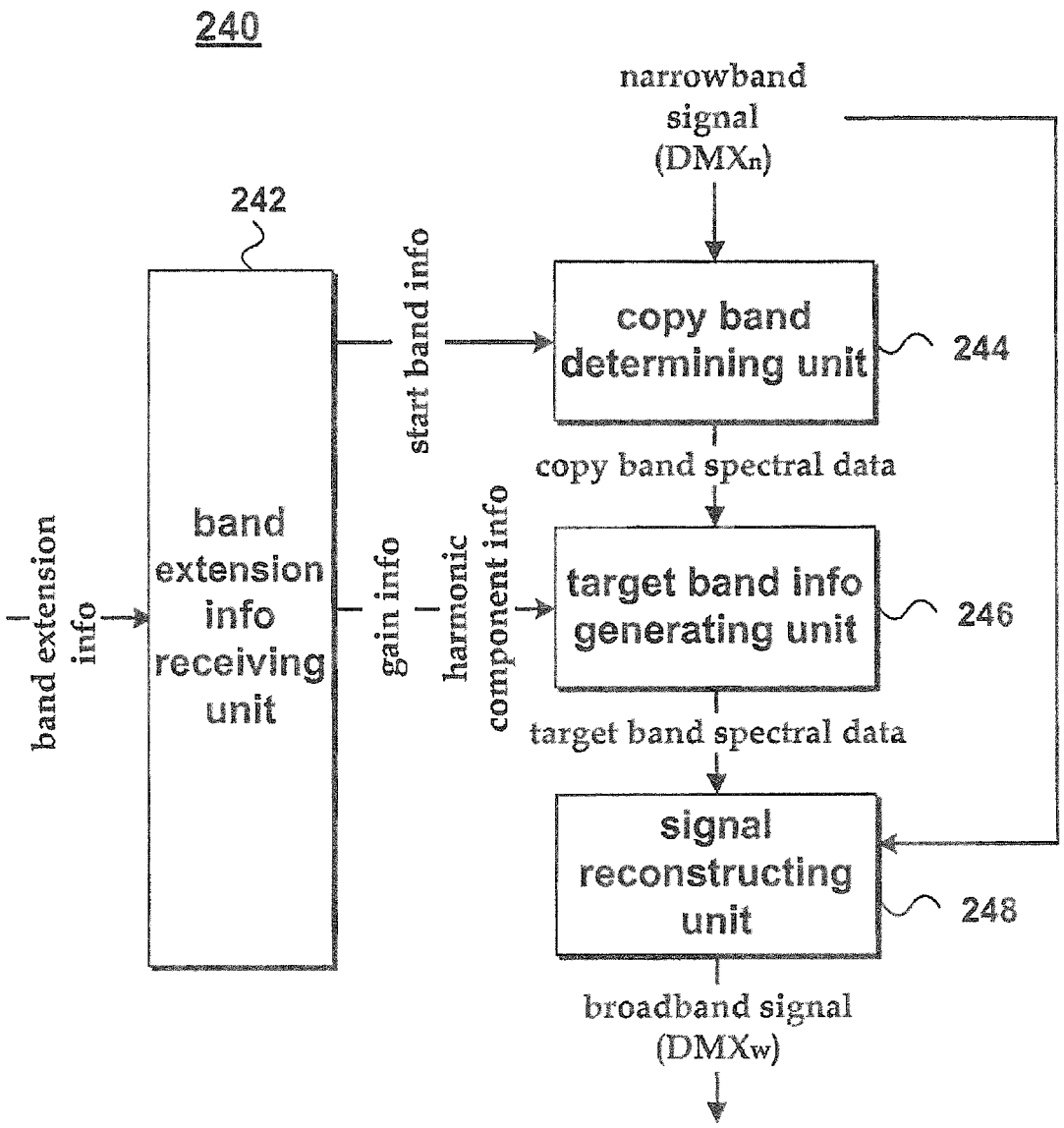
FIG. 6 is a detailed block diagram of a partial band decoding unit shown in FIG. 5.

FIG. 5 is a block diagram of an audio signal decoding apparatus according to an embodiment of the present invention, and FIG. 6 is a detailed block diagram of a partial band decoding unit shown in FIG. 5.

Referring to FIG. 5, an audio signal decoding apparatus 200 according to an embodiment of the present invention includes a demultiplexer 210, an audio signal decoding unit 220, a speech signal decoding unit 230, a partial band decoding unit 240, and a multi-channel decoding unit 250.

The demultiplexer 210 extracts a narrowband downmix $DMX_n$, band extension information and spatial information from a bitstream. If a narrowband downmix signal has more audio characteristic, the audio signal decoding unit 220 decodes the narrowband downmix signal by an audio coding scheme. In this case, as mentioned in the foregoing description, an audio signal can comply with AAC or HE-AAC standard. If the narrowband downmix signal has more speech characteristic, the speech signal decoding unit 230 decoded the narrowband downmix signal by a speech coding scheme.

The partial band decoding unit 240 generates a broadband signal by applying the band extension information to the narrowband downmix, which will be explained in detail with reference to FIG. 6.

The multi-channel decoding unit 250 generates an output signal using the broadband downmix and the spatial information.

Referring to FIG. 6, the partial band decoding unit 240 includes a band extension information receiving unit 242, a copy band determining unit 244 and a target band information generating unit 246. The partial band decoding unit 240 can further include a signal reconstructing unit 248.

The band extension information receiving unit 242 extracts start band information, gain information and harmonic component information from the band extension information, which are sent to the copy band determining unit 244 and the target band information generating unit 246.

The copy band determining unit 244 determines a copy band using a narrowband downmix $DMX_n$ and start band information. In this case, if the narrowband downmix $DMX_n$ is not spectral data of a narrowband, it is converted to spectral data. Moreover, the copy band may be equal to or different from a start band. If the copy band is different from the start band, from a band corresponding to the start band information to a band having spectral data are determined as the copy band. Spectral data determined by the copy band are forwarded to the target band information generating unit 246.

The target band information generating unit 246 generates spectral data of a target band using the spectral data of the copy band, the gain information and the like. Data of target band can be generated by the following formula.

$$sd(\text{target_band}) = g_i \times sd(\text{copy_band}) \quad \text{[Formula 2]}$$

In Formula 2, 'g' indicates a gain of a current band, 'sd (target_band)' indicates spectral data of target band, and 'sd (copy_band)' indicates spectral data of copy band.

In case of the former embodiment shown in (A) of FIG. 4, gain ($g_s$, $g_{s-4}$, $g_{s-2}$, etc.) can be applied to a copy band that is located on the left of a target band. In case of the former embodiment shown in (B) of FIG. 4, for a first target band tb, it is able to apply a gain ($g_s$, $g_{n-3}$) to spectral data of a copy band. For a second target band tb', different gain ($g_s$*$g_{s+1}$, $g_{n-3}$*$g_{n-2}$) can be applied to spectral data of a copy band. In case of the former embodiment shown in (C) of FIG. 4, after a gain ($g_s$) has been applied to spectral data $s_{ds}$ of a copy band corresponding to a partial area of a narrowband, spectral data of a secondary target band (tb) are generated by applying a different gain ($g_{2nd}$) to a whole narrowband.

Figure 7:
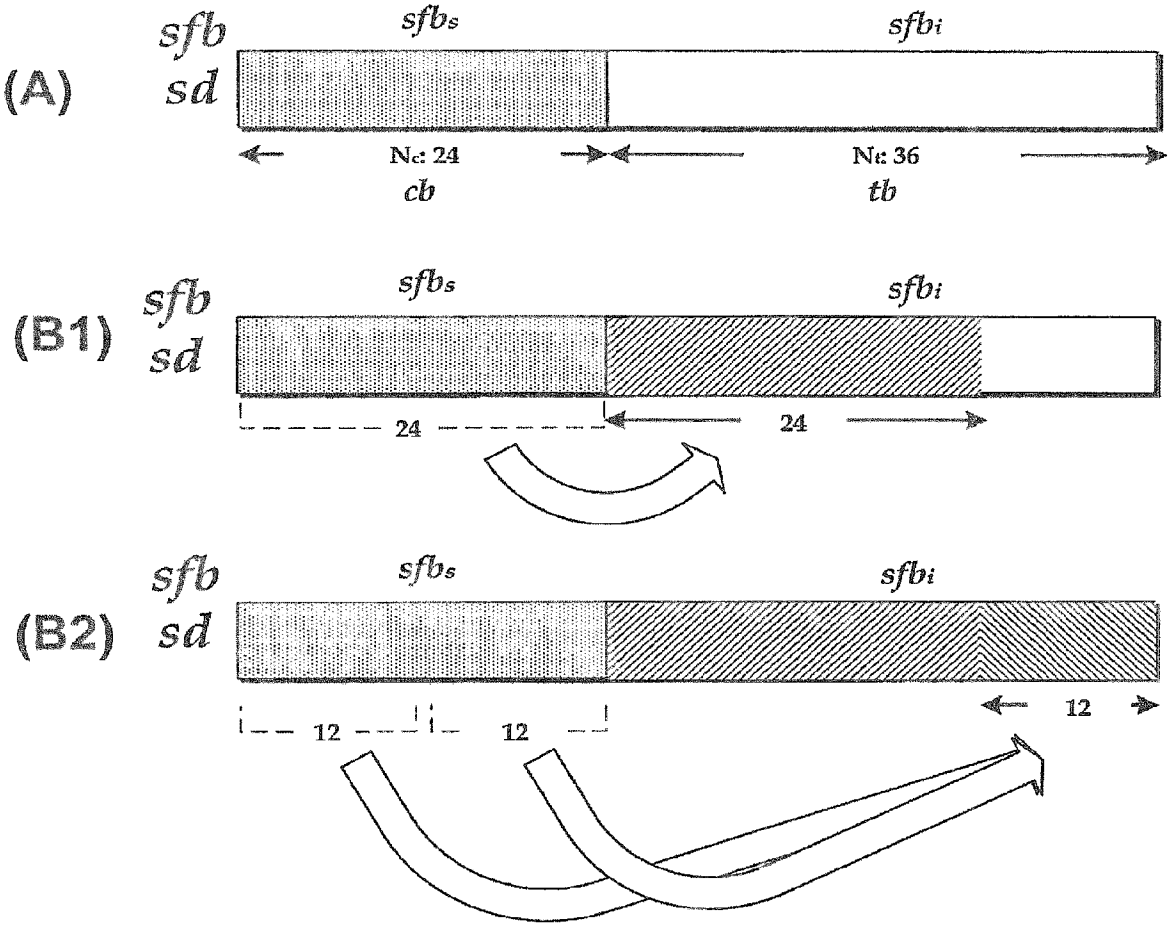
FIG. 7 is a diagram for a case that the number of spectral data of a target band is greater than that of spectral data of a copy band.

Meanwhile, the number of spectral data of target band $N_t$ may differ from the number of spectral data of copy band $N_c$. This case is explained as follows. FIG. 7 is a diagram for a case that the number of spectral data of a target band $N_t$ is greater than that of spectral data of a copy band $N_c$, and FIG. 8 is a diagram for a case that the number of spectral data of a target band $N_t$ is smaller than that of spectral data of a copy band $N_c$.

Referring to (A) of FIG. 7, it can be observed that the number $N_t$ of spectral data of a target band $sfb_t$ is 36 and it can be also observed that the number $N_c$ of spectral data of a copy band $sfb_s$ is 24. In the drawing, the greater the number of data is, the longer a horizontal length of a band gets. Since the number of data of the target band is greater than the other, it is able to use the data of the copy band at least twice. For instance, a low frequency of the target band, as shown in (B1) of FIG. 7, is firstly filled with 24 data of the copy band and the rest of the target band is then filled with 12 data in a front or rear part of the copy band. Of source, it is able to apply the transferred gain information as well.

Figure 8:
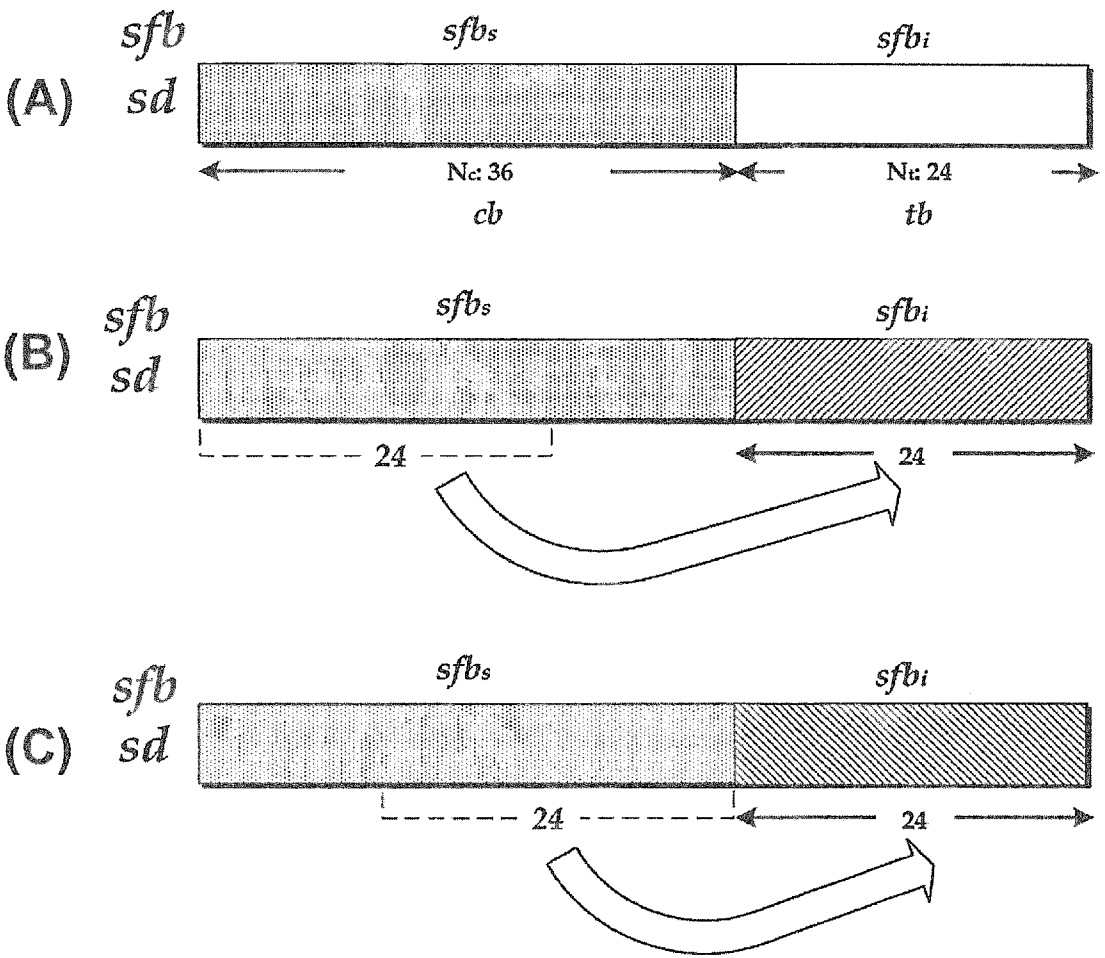
FIG. 8 is a diagram for a case that the number of spectral data of a target band is smaller than that of spectral data of a copy band.

Referring to (A) of FIG. 8, it can be observed that the number $N_t$ of spectral data of a target band $sfb_t$ is 24 and the number $N_c$ of spectral data of a copy band $sfb_s$ is 36. Since the number of data of the target band is smaller than the other, it is able to partially use the data of the copy band only. For instance, it is able to generate spectral data of the target band $sfb_t$ using 24 spectral data in a front area of the copy band $sfb_s$, as shown in (B) of FIG. 8, or 24 spectral data in a rear area of the target band $sfb_t$, as shown in (C) of FIG. 8.

Referring now to FIG. 6, the target information generating unit 246 generates spectral data of the target band by applying the gains in the above-mentioned various methods. In generating the spectral data of the target band, the target band information generating unit 246 is able to further use the harmonic component information. In particular, using the harmonic component information transferred by the encoder, it is able to generate a sub-harmonic signal corresponding to the number of size of the target band by phase synthesis or the like.

The target band information generating unit 246 is able to generate spectra data by combination of a time dilatation/compression step and a decimation step. In this case, the time dilatation/compression step may include a step of dilating a time-domain signal in a temporal direction and this dilatation step can use a phase vocoder scheme. The decimation step may include a step of compressing a time-dilated signal into an original time. It is able to apply the time dilatation/compression step and the decimation step to target band spectral data.

The signal reconstructing unit 248 generates a broadband signal using the target band spectral data and the narrowband signal. In this case, the broadband signal may include spectral data of a broadband or may correspond to a signal in a time domain.

An audio signal processing method according to the present invention can be implemented in a computer-readable program in combination with some hardware and can be stored in a recordable medium. Multimedia data having the data structure of the present invention can also be stored in the computer-readable recordable medium. The recordable media includes all kinds of storage devices which are capable of storing data readable by a computer system. The recordable media include ROM, RAM, CD-ROM, magnetic tapes, floppy discs, optical data storage devices, and the like for example and also include carrier-wave type implementations (e.g., transmission via Internet). Bitstream generated by the encoding method can be stored in a computer-readable recordable media or transmitted via wire/wireless communication network.

Industrial Applicability

Accordingly, the present invention is applicable to encoding/decoding of an audio/video signal.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A method of decoding an audio signal, comprising:

receiving, by a decoding apparatus, spatial information and a narrow-band downmix signal, the narrow-band downmix signal corresponding to a first band from a bitstream;

decoding, by the decoding apparatus, the narrow-band downmix signal using one of an audio coding scheme and a speech coding scheme, wherein the speech coding scheme includes Linear Prediction Coding (LPC);

obtaining, by the decoding apparatus, spectral data corresponding to the first band from the narrow-band downmix signal;

determining, by the decoding apparatus, a copy band based on frequency information of the copy band, the copy band corresponding to a partial band of the first band;

time-dilating the spectral signal of the copy band, and decimating the time dilated spectral signal, wherein the time dilating step dilates a time domain signal using a phase vocoder scheme;

generating, by the decoding apparatus, spectral data of a target band based on the decimated spectral signal, the target band corresponding to the second band using spectral data of the copy band; and generating an output signal using a broadband downmix signal and spatial information, wherein the broadband downmix signal includes the spectral data of the target band and the spectral data of the first band, the output signal including at least two channels, wherein the copy band exists in an upper part of the first band, wherein the frequency information of the copy band comprises at least one of a start frequency, a start band, and index information indicating the start band, and wherein the at least one of a start frequency, a start band, and index information indicating the start band is determined variably per frame and is formed from a high frequency band or a low frequency band based on a numerical value of a brightness of sound for the audio signal using a spectral centroid.

2. The method of claim 1, wherein the spectral data of the target band is generated by using at least one of gain information corresponding to a gain between the spectral data of the copy band and the target band, and harmonic information of the copy band.

3. The method of claim 1, wherein the spatial information is used to generate the output signal by upmixing the broadband downmix signal and includes at least one of channel level difference information, inter-channel correlation information, channel prediction coefficient and downmix gain information.

4. The method of claim 1, wherein a bandwidth of the target band is different from that of the copy band, and at least two bandwidths of the target band are generated using the copy band.

5. The method of claim 4, wherein different gain information is applied to each bandwidth of the target band, and each of the gain information is obtained using an energy ratio between the spectral data of the copy band to the target band.

6. An apparatus configured to decode an audio signal, comprising:

a de-multiplexer configured to receive spatial information and a narrow-band downmix signal, the narrow-band downmix signal corresponding to a first band from a bitstream;

an audio signal decoding unit implemented by a processor to decode the narrow-band downmix signal using an audio coding scheme;

a speech signal decoding unit implemented by the processor to decode the narrow-band downmix signal using a speech coding scheme including Linear Prediction Coding (LPC);

a copy band determining unit implemented by the processor to obtain spectral data corresponding to the first band from the narrow-band downmix signal, and to determine a copy band based on frequency information of the copy band, the copy band corresponding to a partial band of the first band;

a target band information generating unit implemented by the processor to time-dilate the spectral signal of the copy band, and decimate the time dilated spectral signal, wherein the time-dilating of the spectral signal of the copy band includes dilating a time domain signal using a phase vocoder scheme, the target band information generating unit further configured to generate spectral data of a target band, the target band corresponding to a second band using the spectral data of the copy band; and a multi-channel generating unit implemented by the processor to generate an output signal using a broadband downmix signal and spatial information, wherein the broadband downmix signal includes the spectral data of the target band and the spectral data of the first band, the output signal including at least two channels, wherein the copy band exists in an upper part of the first band, wherein the frequency information of the copy band comprises at least one of a start frequency, a start band, and index information indicating the start band, and wherein the at least one of a start frequency, a start band, and index information indicating the start band is determined variably per frame and is formed from a high frequency band or a low frequency band based on a numerical value of a brightness of sound for the audio signal using a spectral centroid.

7. The apparatus of claim 6, wherein the spectral data of the target band is generated using at least one of gain information corresponding to a gain between the spectral data of the copy band and the target band, and harmonic information of the copy band.

8. The apparatus of claim 6, wherein the spatial information is used to generate the output signal by upmixing the broadband downmix signal and includes at least one of channel level difference information, inter-channel correlation information, channel prediction coefficient and downmix gain information.

9. A non-transitory computer-readable storage medium having recorded thereon a computer program for executing an audio decoding method, the audio decoding method comprising:

receiving spatial information and a narrow-band downmix signal, the narrow-band downmix signal corresponding to a first band from a bitstream;

decoding the narrow-band downmix signal using one of an audio coding scheme and a speech coding scheme, wherein the speech coding scheme includes Linear Prediction Coding (LPC);

obtaining spectral data corresponding to the first band from the narrow-band downmix signal;

determining a copy band based on frequency information of the copy band corresponding to a partial band of the first band;

time-dilating the spectral signal of the copy band, and decimating the time dilated spectral signal, wherein the time dilating step dilates a time domain signal using a phase vocoder scheme;

generating spectral data of a target band corresponding to a second band using spectral data of the copy band; and generating an output signal using a broadband downmix signal and spatial information, wherein the broadband downmix signal includes the spectral data of the target band and the spectral data of the first band, wherein the copy band exists in an upper part of the first band, and wherein the at least one of a start frequency, a start band, and index information indicating the start band is determined variably per frame and is formed from a high frequency band or a low frequency band based on a numerical value of a brightness of sound for the audio signal using a spectral centroid.

* * * * *